US010375989B2

(12) United States Patent
Borges de Couraca et al.

(10) Patent No.: US 10,375,989 B2
(45) Date of Patent: Aug. 13, 2019

(54) SMOKING ARTICLE COMPRISING A COMBUSTIBLE HEAT SOURCE AND HOLDER AND METHOD OF MANUFACTURE THEREOF

(71) Applicant: Philip Morris Products S.A., Neuchatel (CH)

(72) Inventors: Ana Carolina Borges de Couraca, Lausanne (CH); Christopher John Grant, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/320,985

(22) PCT Filed: Jun. 26, 2015

(86) PCT No.: PCT/EP2015/064592
§ 371 (c)(1),
(2) Date: Dec. 21, 2016

(87) PCT Pub. No.: WO2015/197850
PCT Pub. Date: Dec. 30, 2015

(65) Prior Publication Data

US 2017/0196261 A1 Jul. 13, 2017

(30) Foreign Application Priority Data

Jun. 27, 2014 (EP) ..... 14174791

(51) Int. Cl.
*A24F 13/00* (2006.01)
*A24F 17/00* (2006.01)
(Continued)

(52) U.S. Cl.
CPC ..... *A24F 47/006* (2013.01)

(58) Field of Classification Search
CPC ..... A24F 47/004; A24F 47/006; A24B 15/16; A24B 15/165
(Continued)

(56) References Cited

U.S. PATENT DOCUMENTS 4,714,082 A * 12/1987 Banerjee ..... A24B 15/165 131/359
5,040,551 A 8/1991 Schlatter et al.
(Continued)

FOREIGN PATENT DOCUMENTS

CN 1031472 A 3/1989
CN 1059841 A 4/1992
(Continued)

OTHER PUBLICATIONS

International Search Report and Written Opinion dated Oct. 28, 2015 in PCT/EP2015/064592 filed Jun. 26, 2015.
(Continued)

*Primary Examiner* — Abdullah A Riyami
*Assistant Examiner* — Thang H Nguyen
(74) *Attorney, Agent, or Firm* — Oblon, McClelland, Maier & Neustadt, L.L.P.

(57) ABSTRACT

A smoking article is provided, including a combustible heat source having opposed front and rear end faces; an aerosol-forming substrate having opposed front and rear end faces, wherein the front end face of the aerosol-forming substrate is downstream of the rear end face of the combustible heat source; and a non-combustible holder configured to hold the combustible heat source. The holder includes a barrier between the rear end face of the combustible heat source and the front end face of the aerosol-forming substrate, and a plurality of first retention fingers connected to the barrier. The first retention fingers extend from the barrier along the exterior of the combustible heat source.

14 Claims, 2 Drawing Sheets

(51) Int. Cl.
*A24F 25/00* (2006.01)
*A24F 47/00* (2006.01)

(58) Field of Classification Search
USPC ..... 131/329
See application file for complete search history.

(56) References Cited

U.S. PATENT DOCUMENTS

| | | | | |
|---|---|---|---|---|
| 5,345,951 | A * | 9/1994 | Serrano | A24B 15/165 131/194 |
| 8,616,217 | B2 * | 12/2013 | Tsurizumi | A24B 15/165 131/194 |
| 2011/0041861 | A1 * | 2/2011 | Sebastian | A24F 47/006 131/365 |
| 2013/0233329 | A1 | 9/2013 | Sebastian et al. | |
| 2015/0083149 | A1 * | 3/2015 | Oglesby | F23C 6/04 131/329 |
| 2015/0107759 | A1 | 4/2015 | Poget et al. | |

FOREIGN PATENT DOCUMENTS

| | | | | |
|---|---|---|---|---|
| CN | 1333657 | A | 1/2002 | |
| CN | 101778578 | A | 7/2010 | |
| EP | 0 472 367 | A1 | 2/1992 | |
| EP | 0472367 | A1 * | 2/1992 | A24F 47/004 |
| JP | 63-192372 | | 8/1988 | |
| JP | 2-84165 | | 3/1990 | |
| JP | 4-258281 | | 9/1992 | |
| JP | 2013-502232 | | 1/2013 | |
| JP | 2015-512266 | | 4/2015 | |
| WO | WO 95/202329 | A1 | 8/1995 | |
| WO | WO 00/28842 | A1 | 5/2000 | |
| WO | WO 2009/022232 | A2 | 2/2009 | |
| WO | WO 2009/074870 | A2 | 6/2009 | |
| WO | 2011/028372 | A1 | 3/2011 | |
| WO | WO 2012/164077 | A1 | 12/2012 | |
| WO | 2013/149810 | A1 | 10/2013 | |
| WO | WO 2013/149810 | A1 | 10/2013 | |
| WO | WO 2013/189836 | A1 | 12/2013 | |
| WO | WO 2014/037270 | A1 | 3/2014 | |
| WO | WO 2015/101595 | A1 | 7/2015 | |

OTHER PUBLICATIONS

Chinese Office Action and Search Report with English translation dated on Jan. 3, 2019 in corresponding Chinese Patent Application No. 201580032340.5, citing documents AO-AT (19 pages).

Japanese Office Action with English translation dated May 30, 2019 in corresponding Japanese Patent Application No. 2016-574150, citing documents AO-AS therein (7 pages).

* cited by examiner

SMOKING ARTICLE COMPRISING A COMBUSTIBLE HEAT SOURCE AND HOLDER AND METHOD OF MANUFACTURE THEREOF

TECHNICAL FIELD

The present invention relates to a smoking article comprising a combustible heat source and a holder for the combustible heat source. The present invention also relates to a method of manufacturing a combustible heat source in a holder for use in such a smoking article.

DESCRIPTION OF THE RELATED ART

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible carbonaceous heat source. During smoking, volatile compounds are released from the aerosol-forming substrate by heat transfer from the combustible heat source and entrained in air drawn through the smoking article. As the released compounds cool, they condense to form an aerosol that is inhaled by the user.

It is known to include a heat-conducting element around and in direct contact with at least a rear portion of the combustible heat source and at least a front portion of the aerosol-forming substrate of the heated smoking article in order to ensure sufficient conductive heat transfer from the combustible heat source to the aerosol-forming substrate to obtain an acceptable aerosol. For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate.

The combustion temperature of a combustible heat source for use in a heated smoking article should not be so high as to result in combustion or thermal degradation of the aerosol forming material during use of the heated smoking article. However, the combustion temperature of the combustible heat source should be sufficiently high to generate enough heat to release sufficient volatile compounds from the aerosol forming material to produce an acceptable aerosol, especially during early puffs.

A variety of combustible carbon-containing heat sources for use in heated smoking articles have been proposed in the art. The combustion temperature of combustible carbon-containing heat sources for use in heated smoking articles is typically between about 600° C. and 800° C. It is known to wrap an insulating member around the periphery of a combustible carbon-containing heat source of a heated smoking article in order to reduce the surface temperature of the heated smoking article.

For example, U.S. Pat. No. 4,714,082 discloses a heated smoking article comprising a combustible carbon-containing fuel element, an aerosol generating means, a heat-conducting member and a peripheral insulating member of resilient, non-burning material, such as a jacket of glass fibers. The insulating member circumscribes at least part of the fuel element and advantageously at least part of the aerosol generating means.

Inclusion of a separate insulating member as disclosed in U.S. Pat. No. 4,714,082 may result in a heated smoking article having a transverse cross-section that is not constant along the length of the smoking article. This may make it more difficult to secure reliably the combustible carbon-containing heat source within the heated smoking article. Inclusion of a separate insulating member as disclosed in U.S. Pat. No. 4,714,082 may also add to the complexity of assembly of the heated smoking article.

The combustible heat sources of heated smoking articles may comprise one or more additives to aid ignition or combustion of the combustible heat source. To facilitate aerosol formation, the aerosol-forming substrates of heated smoking articles typically comprise a polyhydric alcohol such as glycerine or other aerosol-former.

In the smoking article disclosed in WO-A2-2009/022232 the front end face of the aerosol-forming substrate is in direct contact with the rear end face of the combustible heat source. However, it is also known to provide heated smoking articles comprising a combustible heat source having a barrier affixed to the rear end face thereof and an aerosol-forming substrate located downstream of the rear end face of the combustible heat source and the barrier.

The barrier may advantageously prevent or inhibit migration of the aerosol-former from the aerosol-forming substrate to the combustible heat source during storage and use of the heated smoking article, and so avoid or reduce decomposition of the aerosol-former during use of the heated smoking article. The barrier may also advantageously limit or prevent migration of other volatile components of the aerosol-forming substrate from the aerosol-forming substrate to the combustible heat source during storage and during use of smoking articles according to the invention.

Alternatively or in addition, the barrier may advantageously limit the temperature to which the aerosol-forming substrate is exposed during ignition or combustion of the combustible heat source, and so help to avoid or reduce thermal degradation or combustion of the aerosol-forming substrate during use of the heated smoking article.

Alternatively or in addition, the barrier may advantageously prevent or inhibit combustion and decomposition products formed during ignition and combustion of the combustible heat source from entering air drawn through the heated smoking article during use thereof. This is particularly advantageous where the combustible heat source comprises one or more additives to aid ignition or combustion of the combustible heat source or a combination thereof.

WO-A1-2013/149810 and WO-A1-2013/189836 describe methods of manufacturing combustible heat sources having a barrier affixed to an end face thereof in which one or more particulate components are compressed in a mould to form the combustible heat source and affix a barrier punched from a laminar barrier material to an end face of the combustible heat source.

It would be desirable to provide a smoking article having a reduced surface temperature proximate to the combustible heat source and a barrier located between the combustible heat source and the aerosol-forming substrate that may be assembled in a reliable manner.

SUMMARY

According to the invention there is provided a smoking article comprising: a combustible heat source having opposed front and rear end faces; an aerosol-forming substrate having opposed front and rear end faces, wherein the front end face of the aerosol-forming substrate is downstream of the rear end face of the combustible heat source; and a non-combustible holder for the combustible heat source comprising a barrier between the rear end face of the combustible heat source and the front end face of the aerosol-forming substrate and a plurality of first retention fingers about the periphery of the combustible heat source, wherein the first retention fingers are connected to the barrier and extend from the barrier along the exterior of the combustible heat source.

According to the invention there is also provided a combustible heat source assembly for a smoking article comprising: a non-combustible holder comprising a barrier and a plurality of first retention fingers connected to the barrier; and a combustible heat source having opposed front and rear end faces within the holder, wherein the barrier is adjacent the rear end face of the combustible heat source and the first retention fingers extend from the barrier along the exterior of the combustible heat source.

According to the invention there is further provided a method of manufacturing a combustible heat source assembly according to the invention, the method comprising: punching a one piece blank from a laminar material; providing a mould defining a cavity having an opening; covering the opening with the blank; shaping the blank to form a non-combustible holder comprising a barrier and a plurality of first retention fingers extending from the barrier along the periphery of the cavity by inserting a punch into the cavity through the opening; placing one or more particulate components into the holder; and compressing the one or more particulate components to form a combustible heat source within the holder, wherein the barrier is adjacent to a rear end face of the combustible heat source and the first retention fingers extend from the barrier along the exterior of the combustible heat source.

BRIEF DESCRIPTION OF THE DRAWINGS

Embodiments of the invention will now be further described, by way of example only, with reference to the accompanying drawings in which.

DETAILED DESCRIPTION

Figure 1:
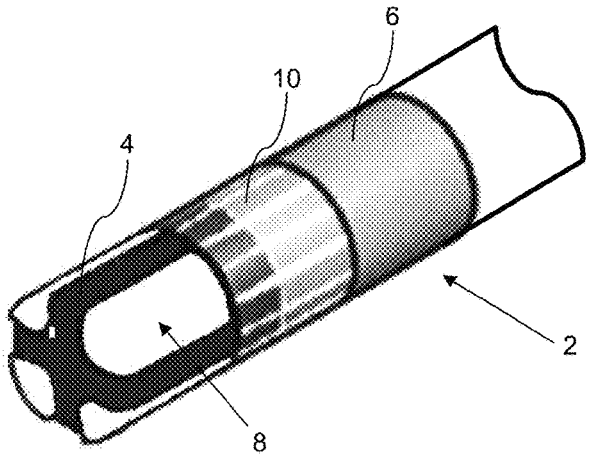
FIG. 1 shows a perspective view of a distal portion of a smoking article according to a first embodiment of the invention.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

The aerosol-forming substrate may be in the form of a plug or segment comprising a material capable of releasing upon heating volatile compounds, which can form an aerosol, circumscribed by a wrapper. Where an aerosol-forming substrate is in the form of such a plug or segment, the entire plug or segment including the wrapper is considered to be the aerosol-forming substrate.

As used herein, the terms 'distal', 'upstream' and 'front', and 'proximal', 'downstream' and 'rear', are used to describe the relative positions of components, or portions of components, of the smoking article. Smoking articles according to the invention comprise a proximal end through which, in use, an aerosol exits the smoking article for delivery to a user. The proximal end of the smoking article may also be referred to as the mouth end. In use, a user draws on the proximal end of the smoking article in order to inhale an aerosol generated by the smoking article.

The combustible heat source is located at or proximate to the distal end. The mouth end is downstream of the distal end. The proximal end may also be referred to as the downstream end of the smoking article and the distal end may also be referred to as upstream end of the smoking article. Components, or portions of components, of smoking articles according to the invention may be described as being upstream or downstream of one another based on their relative positions between the proximal end and the distal end of the smoking article.

The front end face of the combustible heat source is at the upstream end of the combustible heat source. The upstream end of the combustible heat source is the end of the combustible heat source furthest from the proximal end of the smoking article. The rear end face of the combustible heat source is at the downstream end of the combustible heat source. The downstream end of the combustible heat source is the end of the combustible heat source closest to the proximal end of the smoking article.

As used herein, the term 'non-combustible' is used to describe a holder, barrier or other component that is substantially non-combustible at temperatures reached by the combustible heat source during combustion or ignition thereof.

Smoking articles according to the invention comprise a holder comprising a barrier between the combustible heat source and the aerosol-forming substrate and a plurality of first retention fingers about the periphery of the combustible heat source.

Preferably, the barrier is substantially air-impermeable. As used herein, the term 'substantially air-impermeable' is used to describe a barrier that substantially prevents air from being drawn through the barrier into contact with the combustible heat source.

Preferably, the barrier extends across substantially the entire end face of the combustible heat source.

The first retention fingers are connected to the barrier and extend from the barrier along the exterior of the combustible heat source. The first retention fingers extend longitudinally along the exterior of the combustible heat source.

As used herein, the terms 'longitudinal' and 'axial' are used to describe the direction between the opposed front and rear faces of the combustible heat source and the proximal end and the opposed distal end of the smoking article.

The first retention fingers are unconnected along at least a distal end portion thereof. That is, the first retention fingers are not joined or attached to one another along at least a distal end portion thereof.

The first retention fingers advantageously help to hold the combustible heat source in place within the smoking article.

The first retention fingers also space the periphery of the combustible heat source from any material that may come into contact with the distal end of the smoking article during use thereof. This may advantageously reduce the ignition propensity of the smoking article.

Preferably, the first retention fingers are in direct contact with the periphery of the combustible heat source.

The first retention fingers extend from the barrier along the exterior of the combustible heat source towards the front face end face of the combustible heat source.

Preferably, the first retention fingers extend along at least about 75% of the length of the combustible heat source, more preferably along at least 85% of the length of the combustible heat source, most preferably along at least about 95% of the length of the combustible heat source.

As used herein, the term 'length' is used to describe the maximum dimension in the longitudinal direction of the combustible heat source or smoking article. That is, the maximum dimension in the direction between the opposed front and rear faces of the combustible heat source or the proximal end and the opposed distal end of the smoking article.

In certain preferred embodiments, the first retention fingers extend from the barrier along the exterior of the combustible heat source to the front end face of the combustible heat source.

In such embodiments, the distal or upstream ends of the first retention fingers distant from the barrier are preferably configured to retain the combustible heat source within the holder.

In certain preferred embodiments, the first retention fingers extend from the barrier beyond the front end face of the combustible heat source and the distal ends of the first retention fingers are bent, folded or otherwise angled inwardly to engage the front end face of the combustible heat source. In such embodiments, the first retention fingers preferably extend between about 0.5 mm and about 4 mm beyond the front end face of the combustible heat source, more preferably between about 1 mm and about 3 mm beyond the front end face of the combustible heat source.

The first retention fingers are circumferentially spaced apart about the periphery of the combustible heat source. In certain preferred embodiments, the first retention fingers are substantially uniformly spaced apart about the periphery of the combustible heat source.

The circumferential spacing between the first retention fingers aids gas transfer to and from the combustible heat source. This advantageously facilitates ignition and sustained combustion of the combustible heat source.

Preferably, the first retention fingers cover less than or equal to about 50% of the surface of the periphery of the combustible heat source. In certain embodiments, the first retention fingers cover less than or equal to about 40% of the surface of the periphery of the combustible heat source.

Preferably, the first retention fingers cover greater than or equal to about 20% of the surface of the periphery of the combustible heat source, more preferably greater than or equal to about 30% of the surface of the periphery of the combustible heat source.

For example, the first retention fingers may cover between about 20% and about 50% of the surface of the periphery of the combustible heat source or between about 30% and about 40% of the surface of the periphery of the combustible heat source.

Preferably, the holder comprises at least 3 first retention fingers. More preferably, the holder comprises between 3 and 5 first retention fingers.

Preferably, the first retention fingers are formed integrally with the barrier. However, the first retention fingers may alternatively be formed separately from the barrier and then adhered or otherwise attached to the barrier. Where the first retention fingers are formed separately from the barrier, the first retention fingers and the barrier may be formed from the same or different materials.

The holder may further comprise a plurality of second retention fingers connected to the barrier, wherein the second retention fingers extend from the barrier along the exterior of the aerosol-forming substrate.

The second retention fingers extend longitudinally along the exterior of the aerosol-forming substrate.

The second retention fingers advantageously help to hold the aerosol-forming substrate in place within the smoking article. The second retention fingers may also provide a thermal link between the combustible heat source and the aerosol-forming substrate of smoking articles according to the invention. This may advantageously help to facilitate adequate heat transfer from the combustible heat source to the aerosol-forming substrate to provide an acceptable aerosol.

Preferably, the second retention fingers are in direct contact with the periphery of the aerosol-forming substrate.

The second retention fingers may extend from the barrier along the exterior of the aerosol-forming substrate to the rear end face of the aerosol-forming substrate. In such embodiments, the proximal or downstream ends of the second retention fingers distant from the barrier may be configured to retain the aerosol-forming substrate within the holder.

In certain preferred embodiments, the second retention fingers extend from the barrier beyond the rear end face of the aerosol-forming substrate and the proximal ends of the second retention fingers are bent, folded or otherwise angled inwardly to engage the rear end face of the aerosol-forming substrate.

The second retention fingers are circumferentially spaced apart about the periphery of the aerosol-forming substrate. In certain embodiments, the second retention fingers may be substantially uniformly spaced apart about the periphery of the aerosol-forming substrate.

Preferably, the holder comprises at least 3 second retention fingers. More preferably, the holder comprises between 3 and 5 second retention fingers.

Preferably, the second retention fingers are formed integrally with the barrier. However, the second retention fingers may alternatively be formed separately from the barrier and then adhered or otherwise attached to the barrier. Where the second retention fingers are formed separately from the barrier, the second retention fingers and the barrier may be formed from the same or different materials.

Where the first retention fingers and the second retention fingers are formed integrally with the barrier, the first retention fingers and the second retention fingers may be connected to the barrier in an alternating arrangement.

Depending upon the desired characteristics and performance of the smoking article, the barrier, the first retention fingers and, where included, the second retention fingers, may have a low thermal conductivity or a high thermal conductivity. In certain embodiments, the barrier, the first retention fingers and, where included, the second retention fingers, may be formed from material having a bulk thermal conductivity of between about 0.1 W per meter Kelvin (W/(m·K)) and about 200 W per meter Kelvin (W/(m·K)), at 23° C. and a relative humidity of 50% as measured using the modified transient plane source (MTPS) method.

The thickness of the barrier, the first retention fingers and, where included, the second retention fingers may be selected to achieve good smoking performance. In certain embodiments, the barrier the first retention fingers and, where included, the second retention fingers may have a thickness of between about 200 microns and about 600 microns. Preferably, the thickness of barrier, the first retention fingers and, where included, the second retention fingers is between about 300 microns and about 500 microns, more preferably about 300 microns.

The thickness of the barrier may be measured using a microscope, a scanning electron microscope (SEM) or other suitable measurement methods known in the art.

The barrier, the first retention fingers and, where included, the second retention fingers may be formed from any suitable material or combination of materials that are substantially thermally stable at temperatures achieved by the combustible heat source during ignition and combustion.

Preferably, the barrier, the first retention fingers and, where included, the second retention fingers are formed from one or more metallic materials. Preferred materials from which the barrier, the first retention fingers and, where included, the second retention fingers may be formed include, but are not limited to: copper; aluminium; stainless steel; and alloys. Most preferably, the barrier, the first retention fingers and, where included, the second retention fingers are formed from aluminium or an aluminium containing alloy. In particularly preferred embodiments, the barrier is formed from a high temperature aluminium alloy.

As described further below, preferably the barrier, the first retention fingers and, where included, the second retention fingers are formed from a laminar material that is capable of being punched to form the barrier, the first retention fingers and, where included, the second retention fingers. In such embodiments, the barrier and the first retention fingers form a 'convex cap' that covers the rear end of the combustible heat source. This advantageously increases the structural rigidity of the periphery of the rear end face of the combustible heat source covered by the 'convex cap'. It also advantageously reduces the risk of fragmentation of the combustible heat source. Where the holder further comprises a plurality of second retention fingers, the barrier and the second retention fingers also form a 'convex cap' that covers the front end of the aerosol-forming substrate.

Preferably, the rear end face of the combustible heat source abuts the barrier.

As used herein, the term 'abut' is used to describe a component, or portion of a component, being in direct contact with another component, or portion of a component.

In certain embodiments, the barrier is adhered or otherwise affixed to the rear end face of the combustible heat source.

Alternatively or in addition, the first retention fingers may be adhered or otherwise affixed to the periphery of the combustible heat source Alternatively or in addition, where the holder further comprises a plurality of second retention fingers, the second retention fingers may be adhered or otherwise affixed to the periphery of the aerosol-forming substrate.

Where the barrier and the first retention fingers are formed from a laminar material, an adhesive may be pre-applied to the laminar material to adhere one or both of the barrier and the first retention fingers to the combustible heat source. The adhesive may be applied to all or a portion of the laminar material forming one or both of the barrier and the first retention fingers.

Alternatively or in addition, where the holder further comprises a plurality of second retention fingers, an adhesive may be pre-applied to the laminar material to adhere the second retention fingers to the aerosol-forming substrate. The adhesive may be applied to all or a portion of the laminar material forming the second retention fingers.

An adhesive may be pre-applied to the laminar material using any suitable means including, but not limited to, a spray gun, a roller, a slot gun or a combination thereof.

Preferably, the combustible heat source is a combustible carbonaceous heat source.

As used herein, the term 'carbonaceous' is used to describe combustible heat sources, particulate components and particulate materials comprising carbon.

Preferably, the combustible heat source is a combustible carbonaceous heat source having a carbon content of at least about 35 percent, more preferably of at least about 40 percent, most preferably of at least about 45 percent by dry weight of the combustible heat source.

In some embodiments, the combustible heat source may be a combustible carbon-based heat source. As used herein, the term 'carbon-based' is used to describe a combustible heat source comprised primarily of carbon, that is a combustible heat source having a carbon content of at least about 50 percent. For example, the combustible heat source may be a combustible carbon-based heat source having a carbon content of at least about 60 percent, or at least about 70 percent, or at least about 80 percent by dry weight of the combustible heat source.

Where the combustible heat source is a combustible carbonaceous heat source, the combustible heat source may be formed from one or more suitable carbon-containing materials.

One or more binders may be combined with the one or more carbon-containing materials. In such embodiments, the combustible heat source may comprise one or more organic binders, one or more inorganic binders or a combination of one or more organic binders and one or more inorganic binders.

Suitable organic binders include but are not limited to: gums, such as, for example, guar gum; modified celluloses and cellulose derivatives such as, for example, methyl cellulose, carboxymethyl cellulose, hydroxypropyl cellulose and hydroxypropyl methylcellulose; flours; starches; sugars; vegetable oils; and combinations thereof.

Suitable inorganic binders include but are not limited to: clays such as, for example, bentonite and kaolinite; alumino-silicate derivatives such as, for example, cement; alkali activated alumino-silicates; alkali silicates such as, for example, sodium silicates and potassium silicates; limestone derivatives such as, for example, lime and hydrated lime; alkaline earth compounds and derivatives such as, for example, magnesia cement, magnesium sulfate, calcium sulfate, calcium phosphate and dicalcium phosphate; aluminium compounds and derivatives such as, for example, aluminium sulfate and combinations thereof.

Instead of, or in addition to one or more binders, the combustible heat source may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, zirconium and combinations thereof), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Preferably, the combustible heat source comprises carbon and at least one ignition aid. In certain preferred embodiments, the combustible heat source comprises carbon and at least one ignition aid as described in WO-A1-2012/164077.

As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' is also used to denote an elemental metal that releases energy during ignition of the combustible carbonaceous heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of a combustible carbonaceous heat source, such alkali metal burn salts do not release enough energy during ignition of a combustible carbonaceous heat source to produce an acceptable aerosol during early puffs of a smoking article comprising the combustible carbonaceous heat source.

Examples of suitable ignition aids include, but are not limited to: energetic materials that react exothermically with oxygen upon ignition of the combustible heat source such as, for example, aluminium, iron, magnesium and zirconium; thermites or thermite composites comprising a reducing agent such as, for example, a metal, and an oxidizing agent such as, for example, a metal oxide, that react with one another to release energy upon ignition of the combustible heat source; materials that undergo exothermic reactions upon ignition of the combustible heat source such as, for example, intermetallic and bi-metallic materials, metal carbides and metal hydrides; and oxidizing agents that decompose to release oxygen upon ignition of the combustible heat source.

Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulfates; sulfites; other sulfoxides; phosphates; phospinates; phosphites; and phosphanites.

The combustible heat source is preferably formed by mixing one or more carbon-containing materials with one or more binders and any other additives, where included, and forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction or pressing Preferably, the combustible heat source is formed by a pressing process or an extrusion process. Most preferably, the combustible heat source is formed by a pressing process.

Preferably, the mixture of one or more carbon-containing materials, one or more binders and optional other additives is formed into a cylindrical rod. However, it will be appreciated that the mixture of one or more carbon-containing materials, one or more binders and optional other additives may be formed into other desired shapes.

After formation, the cylindrical rod or other desired shape is preferably dried to reduce its moisture content.

The combustible heat source may comprise a single layer. Alternatively, the combustible heat source may be multi-layer combustible heat source comprising a plurality of layer.

Preferably, the combustible heat source has an apparent density of between about 0.8 g/cm$^3$ and about 1.1 g/cm$^3$.

Preferably, the combustible heat source has a mass of between about 300 mg and about 500 mg, more preferably of between about 400 mg and about 450 mg.

Preferably, the combustible heat source has a length of between about 7 mm and about 17 mm, more preferably of between about 7 mm and about 15 mm, most preferably of between about 7 mm and about 13 mm.

Preferably, combustible heat sources according to the invention have a diameter of between about 5 mm and about 9 mm, more preferably of between about 7 mm and about 8 mm.

As used herein, the term 'diameter' denotes the maximum dimension in the transverse direction of the combustible heat source or smoking article. As used herein, the terms 'radial' and 'transverse' are used to describe the direction perpendicular to the longitudinal direction. That is, the direction perpendicular to the direction between the opposed front and rear faces of the combustible heat source and the proximal end and the opposed distal end of the smoking article.

Preferably, the combustible heat source is of substantially uniform diameter. However, the combustible heat source may alternatively be tapered such that the diameter of one of the front end face and the rear end face of the combustible heat source is greater than the diameter of the other of the front end face and the rear end face thereof. For example, combustible heat sources according to the invention may be tapered such that the diameter of the rear end face of the combustible heat source is greater that the diameter of the front end face of the combustible heat source.

Preferably, the combustible heat source is substantially cylindrical. The combustible heat source may be a cylindrical combustible heat source of substantially circular cross-section or of substantially elliptical cross-section.

In particularly preferred embodiments, the combustible heat source is a substantially cylindrical combustible heat source of substantially circular cross-section.

The combustible heat source may be a non-blind combustible heat source. Combustible heat sources according to the invention may be non-blind combustible heat sources. As used herein, the term 'non-blind' is used to describe a combustible heat source, wherein at least one aperture is provided in the barrier and wherein the combustible heat source includes at least one airflow channel extending from the front end face of the combustible heat source to the rear end face of the combustible heat source.

As used herein, the term 'airflow channel' is used to describe a channel extending along the length of the combustible heat source through which air may be drawn for inhalation by a user.

Where the combustible heat source is a non-blind combustible heat sources the at least one aperture provided in the barrier allows air to be drawn along the length of the combustible heat source through the at least one airflow channel for inhalation by a user.

In smoking articles according to the invention comprising a non-blind combustible heat source heating of the aerosol-forming substrate occurs by conduction and forced convection.

The one or more airflow channels may comprise one or more enclosed airflow channels.

As used herein, the term 'enclosed' is used to describe airflow channels that extend through the interior of the non-blind combustible heat source and are surrounded by the non-blind combustible heat source.

Alternatively or in addition, the one or more airflow channels may comprise one or more non-enclosed airflow channels. For example, the one or more airflow channels may comprise one or more grooves or other non-enclosed airflow channels that extend along the exterior of the non-blind combustible heat source.

The one or more airflow channels may comprise one or more enclosed airflow channels or one or more non-enclosed airflow channels or a combination thereof.

In certain embodiments, the combustible heat source may be a non-blind combustible heat source comprising one, two or three airflow channels.

In certain embodiments, the combustible heat source is a non-blind combustible heat source comprising a single airflow channel.

In certain embodiments, the combustible heat source is a non-blind combustible heat source comprising a single substantially central or axial airflow channel. In such embodiments, the diameter of the single airflow channel is preferably between about 1.5 mm and about 3 mm.

It will be appreciated that in addition to one or more airflow channels through which air may be drawn for inhalation by a user, where the combustible heat source is a non-blind combustible heat source the non-blind combustible heat source may also comprise one or more closed or blocked passageways through which air may not be drawn for inhalation by a user.

For example, the non-blind combustible heat source may comprise one or more airflow channels extending from the front end face of the non-blind combustible heat source to the rear end face of the non-blind combustible heat source and one or more closed passageways that extend only part way along the length of the non-blind combustible heat source from the front end face of the non-blind combustible heat source.

The inclusion of one or more closed air passageways increases the surface area of the non-blind combustible heat source that is exposed to oxygen from the air and may advantageously facilitate ignition and sustained combustion of the combustible heat source.

Where the combustible heat source is a non-blind combustible heat source, an additional barrier may be provided between the non-blind combustible heat source and the one or more airflow channels.

The additional barrier between the non-blind combustible heat source and the one or more airflow channels may advantageously substantially prevent or inhibit combustion and decomposition products formed during ignition and combustion of the non-blind combustible heat source from entering air drawn into the smoking article through the one or more airflow channels as the drawn air passes through the one or more airflow channels.

Inclusion of an additional barrier between the non-blind combustible heat source and the one or more airflow channels may also advantageously substantially prevent or inhibit activation of combustion of the non-blind combustible heat source during puffing by a user. This may substantially prevent or inhibit spikes in the temperature of the aerosol-forming substrate of the smoking article during puffing by a user.

By preventing or inhibiting activation of combustion of the non-blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

Preferably, the additional barrier is non-combustible.

Preferably, the additional barrier is substantially air-impermeable.

The additional barrier may be adhered or otherwise affixed to the non-blind combustible heat source.

In certain embodiments, the additional barrier comprises a non-combustible, substantially air impermeable barrier coating provided on an inner surface of the one or more airflow channels. In such embodiments, preferably the additional barrier comprises a barrier coating provided on at least substantially the entire inner surface of the one or more airflow channels. More preferably, the additional barrier comprises a barrier coating provided on the entire inner surface of the one or more airflow channels.

As used herein, the term 'barrier coating' is used to describe a layer of barrier material that covers and is adhered to the combustible heat source.

In other embodiments, the additional barrier may be provided by insertion of a liner into the one or more airflow channels. For example, where the one or more airflow channels comprise one or more enclosed airflow channels that extend through the interior of the non-blind combustible heat source, a non-combustible substantially air impermeable hollow tube may be inserted into each of the one or more airflow channels.

Depending upon the desired characteristics and performance of the smoking article, the additional barrier may have a low thermal conductivity or a high thermal conductivity. Preferably, the additional barrier has a low thermal conductivity.

The thickness of the additional barrier may be appropriately adjusted to achieve good smoking performance. In certain embodiments, the additional barrier may have a thickness of between about 30 microns and about 200 microns. In a preferred embodiment, the additional barrier has a thickness of between about 30 microns and about 100 microns.

The additional barrier may be formed from one or more suitable materials that are substantially thermally stable and non-combustible at temperatures achieved by the non-blind combustible heat source during ignition and combustion thereof. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the additional barrier may be formed include clays, glasses, aluminium, iron oxide and combinations thereof. If desired, catalytic ingredients, such as ingredients that promote the oxidation of carbon monoxide to carbon dioxide, may be incorporated in the additional barrier. Suitable catalytic ingredients include, but are not limited to, for example, platinum, palladium, transition metals and their oxides.

Where the additional barrier comprises a barrier coating provided on an inner surface of the one or more airflow channels, the barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the barrier coating. In certain preferred embodiments, the barrier coating is applied to the inner surface of the one or more airflow channels by the process described in WO-A2-2009/074870 as the non-blind combustible heat source is extruded.

Preferably, the combustible heat source is a blind combustible heat source. As used herein, the term 'blind' is used to describe a combustible heat source that does not include any airflow channels extending from the front end face of the combustible heat source to the rear end face of the combustible heat source. As used herein, the term 'blind' is also used to describe a combustible heat source including one or more airflow channels extending from the front end face of the combustible heat source to the rear end face of the combustible heat source, wherein the barrier prevents air from being drawn along the length of the combustible heat source through the one or more airflow channels.

In smoking articles according to the invention comprising a blind combustible heat source heat transfer from the blind combustible heat source to the aerosol-forming substrate occurs primarily by conduction and heating of the aerosol-forming substrate by forced convection is minimised or reduced.

In such embodiments, in use air drawn through the smoking article for inhalation by a user does not pass through any airflow channels along the blind combustible heat source. The lack of any airflow channels through the blind combustible heat source advantageously substantially prevents or inhibits activation of combustion of the blind combustible heat source during puffing by a user. This substantially prevents or inhibits spikes in the temperature of the aerosol-forming substrate during puffing by a user.

By preventing or inhibiting activation of combustion of the blind combustible heat source, and so preventing or inhibiting excess temperature increases in the aerosol-forming substrate, combustion or pyrolysis of the aerosol-forming substrate under intense puffing regimes may be advantageously avoided. In addition, the impact of a user's puffing regime on the composition of the mainstream aerosol may be advantageously minimised or reduced.

The inclusion of a blind combustible heat source may also advantageously substantially prevent or inhibit combustion and decomposition products and other materials formed during ignition and combustion of the blind combustible heat source from entering air drawn through the smoking article during use thereof.

It will be appreciated that where the combustible heat source is a blind combustible heat source the blind combustible heat source may comprise one or more closed or blocked passageways through which air may not be drawn for inhalation by a user.

For example, the blind combustible heat source may comprise one or more closed passageways that extend only part way along the length of the blind combustible heat source from the front end face of the blind combustible heat source.

The inclusion of one or more closed air passageways increases the surface area of the blind combustible heat source that is exposed to oxygen from the air and may advantageously facilitate ignition and sustained combustion of the blind combustible heat source.

Combustible heat source assemblies according to the invention may be manufactured by pre-forming the holder and pre-forming the combustible heat source and then inserting the combustible heat source into the holder. Where the first retention fingers extend from the barrier beyond the front end face of the combustible heat source, the distal ends of the first retention fingers may be bent, folded or otherwise angled inwardly to engage the front end face of the combustible heat source after the combustible heat source has been inserted into the holder.

Where the holder further comprises a plurality of second retention fingers, the method may also comprise pre-forming the aerosol-forming substrate and inserting the aerosol-forming substrate into the holder. Where the second retention fingers extend from the barrier beyond the rear end face of the aerosol-forming substrate, the proximal ends of the second retention fingers may be bent, folded or otherwise angled inwardly to engage the rear end face of the aerosol-forming substrate after the aerosol-forming substrate has been inserted into the holder.

Alternatively, combustible heat source assemblies according to the invention may be manufactured by pre-forming the holder and then forming the combustible heat source within the holder.

According to the invention there is provided a method of manufacturing a combustible heat source assembly according to the invention, the method comprising: punching a one piece blank from a laminar material; providing a mould defining a cavity having an opening; covering the opening with the blank; shaping the blank to form a non-combustible holder comprising a barrier and a plurality of first retention fingers extending from the barrier along the periphery of the cavity by inserting a punch into the cavity through the opening; placing one or more particulate components into the holder; and compressing the one or more particulate components to form a combustible heat source within the holder, wherein the barrier is adjacent to a rear end face of the combustible heat source and the first retention fingers extend from the barrier along the exterior of the combustible heat source.

As used herein, the term 'particulate component' is used to describe any flowable particulate material or combination of particulate materials including, but not limited to, powders and granules. Particulate components used in methods according to the invention may comprise two or more particulate materials of different types. Alternatively or in addition, particulate components used in the method of the invention may comprise two or more particulate materials of different composition.

As used herein, the term 'different composition' is used to refer to materials or components formed from different compounds, or from a different combination of compounds, or from a different formulation of the same combination of compounds.

In certain preferred embodiments, the step of compressing the one or more particulate components to form the combustible heat source within the holder is carried out in the same mould used to shape the blank to form the holder.

In such embodiments the method comprises: punching a one piece blank from a laminar material; providing a first mould defining a first cavity having a first opening; covering the first opening with the blank; shaping the blank to form a non-combustible holder comprising a barrier and a plurality of first retention fingers extending from the barrier along the periphery of the first cavity by inserting a punch into the first cavity through the first opening: placing one or more particulate components into the holder within the first cavity through the first opening; compressing the one or more particulate components to form a combustible heat source within the holder, wherein the barrier is adjacent to a rear end face of the combustible heat source and the first retention fingers extend from the barrier along the exterior of the combustible heat source, by inserting a punch into the first cavity through the first opening; and ejecting the combustible heat source and non-combustible holder from the first mould.

Preferably, the method comprises ejecting the combustible heat source and non-combustible holder from the mould through the first opening.

The step of compressing the one or more particulate components to form the combustible heat source within the holder may be carried out using the same punch used to shape the blank to form the holder. That is, the method may comprise punching a one piece blank from a laminar material; providing a first mould defining a first cavity having a first opening; covering the first opening with the blank; shaping the blank to form a non-combustible holder comprising a barrier and a plurality of first retention fingers extending from the barrier along the periphery of the first cavity by inserting a first punch into the first cavity through the first opening; placing one or more particulate components into the holder within the first cavity through the first opening; compressing the one or more particulate components to form a combustible heat source within the holder, wherein the barrier is adjacent to a rear end face of the combustible heat source and the first retention fingers extend from the barrier along the exterior of the combustible heat source, by inserting the first punch into the first cavity through the first opening; and ejecting the combustible heat source and non-combustible holder from the first mould.

Preferably, the first cavity and the first punch are cylindrical and of corresponding substantially circular cross-section. Alternatively, the first cavity and the first punch may be cylindrical and of corresponding substantially elliptical cross-section.

Preferably, the first punch is an upper punch. In such embodiments, the holder and the combustible heat source are formed by inserting the first punch downwardly into the first cavity through the first opening, which is located at an upper end of the first mould.

The method may comprise ejecting the combustible heat source and non-combustible holder from the first mould through the first opening by removing the first punch from the first mould through the first opening and moving the first mould in a direction substantially opposite to the direction in which the first punch, is removed from the first mould.

Alternatively, the step of compressing the one or more particulate components to form the combustible heat source within the holder may be carried out using a different punch to that used to shape the blank to form the holder. That is, the method may comprise punching a one piece blank from a laminar material; providing a first mould defining a first cavity having a first opening; covering the first opening with the blank; shaping the blank to form a non-combustible holder comprising a barrier and a plurality of first retention fingers extending from the barrier along the periphery of the cavity by inserting a first punch into the first cavity through the first opening; placing one or more particulate components into the holder within the first cavity through the first opening; compressing the one or more particulate components to form a combustible heat source within the holder, wherein the barrier is adjacent to a rear end face of the combustible heat source and the first retention fingers extend from the barrier along the exterior of the combustible heat source, by inserting a second punch into the first cavity through the first opening; and ejecting the combustible heat source and non-combustible holder from the first mould.

Preferably, the first cavity, the first punch and the second punch are cylindrical and of corresponding substantially circular cross-section. Alternatively, the first cavity, the first punch and the second punch may be cylindrical and of corresponding substantially elliptical cross-section.

Preferably, the first punch and the second punches are upper punches. In such embodiments, the holder and the combustible heat source are formed by inserting the first punch and the second punch, respectively, downwardly into the first cavity through the first opening, which is located at an upper end of the first mould.

The method may comprise ejecting the combustible heat source and non-combustible holder from the first mould through the first opening by removing the second punch from the first mould through the first opening and moving the first mould in a direction substantially opposite to the direction in which the second punch, is removed from the first mould.

In alternative embodiments, the step of compressing the one or more particulate components to form the combustible heat source within the holder is carried out in a different mould than that used to shape the blank to form the holder.

In such embodiments the method comprises: punching a one piece blank from a laminar material; providing a first mould defining a first cavity having a first opening; covering the first opening with the blank; shaping the blank to form a non-combustible holder comprising a barrier and a plurality of first retention fingers extending from the barrier along the periphery of the first cavity by inserting a punch into the first cavity through the first opening: ejecting the holder from the first mould; providing a second mould defining a second cavity having a second opening; placing the holder within the second cavity; placing one or more particulate components into the holder within the second cavity through the second opening; compressing the one or more particulate components to form a combustible heat source within the holder, wherein the barrier is adjacent to a rear end face of the combustible heat source and the first retention fingers extend from the barrier along the exterior of the combustible heat source, by inserting a second punch into the second cavity through the second opening; and ejecting the combustible heat source and non-combustible holder from the second mould.

Preferably, the first cavity, the first punch, the second cavity and the second punch are cylindrical and of corresponding substantially circular cross-section. Alternatively, the first cavity, the first punch, the second cavity and the second punch may be cylindrical and of corresponding substantially elliptical cross-section.

Preferably, the first punch and the second punches are upper punches. In such embodiments, the holder is formed by inserting the first punch downwardly into the first cavity through the first opening, which is located at an upper end of the first mould and the combustible heat source is formed by inserting the second punch downwardly into the second cavity through the second opening, which is located at an upper end of the second mould.

The method may comprise ejecting the combustible heat source and non-combustible holder from the second mould through the second opening by removing the second punch from the second mould through the second opening and moving the second mould in a direction substantially opposite to the direction in which the second punch is removed from the second mould.

Where the first retention fingers extend from the barrier beyond the front end face of the combustible heat source, the method may further comprising folding the distal ends of the first retention fingers inwardly to engage the front end face of the combustible heat source.

Where the holder further comprises a plurality of second retention fingers, the method may further comprise: preforming an aerosol-forming substrate; shaping the blank to form a plurality of second retention fingers extending from the barrier of the holder; and inserting the aerosol-forming substrate into the holder.

Where the second retention fingers extend from the barrier beyond the rear end face of the aerosol-forming substrate, the method may further comprising folding the proximal ends of the second retention fingers inwardly to engage the rear end face of the aerosol-forming substrate.

Preferably, the method comprises placing the one or particulate components in the first cavity or the second cavity using a gravity fed hopper. In certain embodiments, the method comprises advancing the hopper over the first opening of the first cavity or the second opening of the second cavity in order to place the one or more particulate components in the first cavity or the second cavity, respectively, and then retracting the hopper from the first opening of the first cavity or the second opening of the second cavity.

In certain embodiments, the method may comprise using the hopper to remove a previously manufactured combustible heat source assembly that has been ejected from the first mould or the second mould during the step of advancing the hopper over the first opening of the first cavity or the second opening of the second cavity.

In certain embodiments, the hopper may comprise an outlet for dispensing the one or more particulate components that is substantially sealed against the first mould or the second mould until the outlet is over the first opening of the first cavity or the second opening of the second cavity.

As used herein, the term 'sealed' is used to mean that particulate matter contained in the hopper is prevented from exiting the hopper through the outlet.

To allow the simultaneous manufacture of multiple combustible heat source assemblies, the method may comprise providing: a plurality of first moulds each provided with a corresponding first punch; a plurality of first moulds each provided with a corresponding first punch and a corresponding second punch; or a plurality of first moulds each provided with a corresponding first punch and a plurality of second moulds each provided with a corresponding second punch.

The plurality of moulds may be provided in a single row or in multiple rows.

Alternatively, the method of the invention may be carried out using a continuously rotating multi-cavity or so-called 'turret press'. In such embodiments, multiple moulds are rotated about a central axis and one or more particulate components are placed into the cavities of the moulds through the openings thereof using a hopper.

The method may further comprise applying an adhesive to the laminar material prior to punching the one piece blank from the laminar material. The adhesive may be applied to the laminar material using any suitable means including, but not limited to, a spray gun, a roller, a slot gun or a combination thereof.

In certain embodiments, the method further comprises punching a one piece blank from a laminar material to which an adhesive has been pre-applied.

Alternatively, the method may further comprise applying an adhesive to the one piece blank prior to covering the first opening of the first mould with the blank. The adhesive may be applied to the blank using any suitable means including, but not limited to, a spray gun, a roller, a slot gun or a combination thereof.

In such embodiments, compressing the one or more particulate components to form the combustible heat source adheres the barrier to the rear end face of the combustible heat.

The method of the invention may be used to manufacture combustible heat source assemblies comprising combustible heat sources that are blind or non-blind.

The method of the invention may be used to manufacture combustible heat source assemblies comprising combustible heat sources comprising a single layer. Alternatively, the method of the invention may be used to manufacture combustible heat source assemblies comprising multilayer combustible heat sources comprising a plurality of layers.

For example, to manufacture a combustible heat source assembly comprising a bilayer combustible heat source, the method of the invention may comprise placing a first particulate component and a second particulate component in the first cavity or the second cavity and compressing the first particulate component to form a first layer of the bilayer combustible heat source and compressing the second layer to form a second layer of the bilayer combustible heat source.

Preferably, the aerosol-forming substrate comprises at least one aerosol-former and a material capable of releasing volatile compounds in response to heating. The aerosol-forming substrate may comprise other additives and ingredients including, but not limited to, humectants, flavourants, binders and mixtures thereof.

Preferably, the aerosol-forming substrate comprises nicotine. More preferably, the aerosol-forming substrate comprises tobacco.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

The material capable of emitting volatile compounds in response to heating may be a charge of plant-based material. The material capable of emitting volatile compounds in response to heating may be a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon.

Preferably, the material capable of emitting volatile compounds in response to heating is a charge of tobacco-based material, most preferably a charge of homogenised tobacco-based material.

The aerosol-forming substrate may be in the form of a plug or segment comprising a material capable of emitting volatile compounds in response to heating circumscribed by a paper or other wrapper. As stated above, where an aerosol-forming substrate is in the form of such a plug or segment, the entire plug or segment including any wrapper is considered to be the aerosol-forming substrate.

The aerosol-forming substrate preferably has a length of between about 5 mm and about 20 mm. In certain embodiments, the aerosol-forming substrate may have a length of between about 6 mm and about 15 mm or a length of between about 7 mm and about 12 mm.

In preferred embodiments, the aerosol-forming substrate comprises a plug of tobacco-based material wrapped in a plug wrap. In particularly preferred embodiments, the aerosol-forming substrate comprises a plug of homogenised tobacco-based material wrapped in a plug wrap.

Smoking articles according to the invention may comprise one or more first air inlets around the periphery of the aerosol-forming substrate.

In such embodiments, in use, cool air is drawn into the aerosol-forming substrate of the smoking article through the first air inlets. The air drawn into the aerosol-forming substrate through the first air inlets passes downstream through the smoking article from the aerosol-forming substrate and exits the smoking article through the proximal end thereof.

In such embodiments, during puffing by a user the cool air drawn through the one or more first air inlets around the periphery of the aerosol-forming substrate advantageously reduces the temperature of the aerosol-forming substrate. This advantageously substantially prevents or inhibits spikes in the temperature of the aerosol-forming substrate during puffing by a user.

As used herein, the term 'cool air' is used to describe ambient air that is not significantly heated by the combustible heat source upon puffing by a user.

By preventing or inhibiting spikes in the temperature of the aerosol-forming substrate, the inclusion of one or more first air inlets around the periphery of the aerosol-forming substrate, advantageously helps to avoid or reduce combustion or pyrolysis of the aerosol-forming substrate under intense puffing regimes. In addition, the inclusion of one or more first air inlets around the periphery of the aerosol-forming substrate advantageously helps to minimise or reduce the impact of a user's puffing regime on the composition of the mainstream aerosol of smoking articles according to the invention.

The number, shape, size and location of the first air inlets may be appropriately adjusted to achieve a good smoking performance.

In certain embodiments, the front end face of the aerosol-forming substrate may abut the barrier.

In other embodiments, the front end face of the aerosol-forming substrate may be spaced apart from the barrier. That is, there may be a space or gap between the front end face of the aerosol-forming substrate and the barrier.

In such embodiments, alternatively or in addition to one for more first air inlets around the periphery of the aerosol-forming substrate, smoking articles according to the invention may comprise one or more second air inlets between the barrier and the front end face of the aerosol-forming substrate. In use, cool air is drawn into the space between the barrier and the front end face of the aerosol-forming substrate through the second air inlets. The air drawn into the space between the barrier and the front end face of the aerosol-forming substrate through the second air inlets passes downstream through the smoking article from the space between the barrier and the aerosol-forming substrate and exits the smoking article through the proximal end thereof.

In such embodiments, during puffing by a user cool air drawn through the one or more second inlets between the barrier and the front end face of the aerosol-forming substrate may advantageously reduce the temperature of the aerosol-forming substrate of smoking articles according to the invention. This may advantageously substantially prevent or inhibit spikes in the temperature of the aerosol-forming substrate of smoking articles according to the invention during puffing by a user.

Alternatively or in addition to one or both of one or more first air inlets around the periphery of the aerosol-forming substrate and one or more second inlets between the barrier and the front end face of the aerosol-forming substrate, smoking articles according to the invention may further comprise one or more third air inlets downstream of the aerosol-forming substrate.

Alternatively or in addition to a plurality of second retention fingers extending from the barrier along the exterior of the aerosol-forming substrate, smoking articles according to the invention may further comprise one or more heat-conducting elements around at least a rear portion of the holder and at least a front portion of the aerosol-forming substrate.

Smoking articles according to the invention may comprise a heat-conducting element around and in direct contact with both at least a rear portion of the holder and at least a front portion of the aerosol-forming substrate. In such embodiments, the heat-conducting element provides a thermal link between the combustible heat source and the aerosol-forming substrate of smoking articles according to the invention and advantageously helps to facilitate adequate heat transfer from the combustible heat source to the aerosol-forming substrate to provide an acceptable aerosol.

Alternatively or in addition, smoking articles according to the invention may comprise a heat-conducting element spaced apart from one or both of the holder and the aerosol-forming substrate, such that there is no direct contact between the heat-conducting element and one or both of the holder and the aerosol-forming substrate.

The one or more heat-conducting elements are preferably non-combustible. In certain embodiments, the one or more heat conducting element may be oxygen restricting. In other words, the one or more heat-conducting elements may inhibit or resist the passage of oxygen through the heat-conducting element.

Suitable heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers. Smoking articles according to the invention preferably comprise a mouthpiece located at the proximal end thereof.

Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece. The mouthpiece may comprise a filter comprising one or more segments comprising suitable known filtration materials. Suitable filtration materials are known in the art and include, but are not limited to, cellulose acetate and paper. Alternatively or in addition, the mouthpiece may comprise one or more segments comprising absorbents, adsorbents, flavourants, and other aerosol modifiers and additives or combinations thereof.

Smoking articles according to the invention preferably further comprise a transfer element or spacer element between the aerosol-forming substrate and the mouthpiece.

The transfer element may abut one or both of the aerosol-forming substrate and the mouthpiece. Alternatively, the transfer element may be spaced apart from one or both of the aerosol-forming substrate and the mouthpiece.

The inclusion of a transfer element advantageously allows cooling of the aerosol generated by heat transfer from the combustible heat source to the aerosol-forming substrate. The inclusion of a transfer element also advantageously allows the overall length of the smoking article to be adjusted to a desired value, for example to a length similar to that of a conventional cigarette, through an appropriate choice of the length of the transfer element.

The transfer element may have a length of between about 7 mm and about 50 mm, for example a length of between about 10 mm and about 45 mm or of between about 15 mm and about 30 mm. The transfer element may have other lengths depending upon the desired overall length of the smoking article, and the presence and length of other components within the smoking article.

Preferably, the transfer element comprises at least one open-ended tubular hollow body. In such embodiments, in use, air drawn into the smoking article passes through the at least one open-ended tubular hollow body as it passes downstream through the smoking article from the aerosol-forming substrate to the mouthpiece.

The transfer element may comprise at least one open-ended tubular hollow body formed from one or more suitable materials that are substantially thermally stable at the temperature of the aerosol generated by the transfer of heat from the combustible heat source to the aerosol-forming substrate. Suitable materials are known in the art and include, but are not limited to, paper, cardboard, plastics, such a cellulose acetate, ceramics and combinations thereof.

Alternatively or in addition, smoking articles according to the invention may comprise an aerosol-cooling element or heat exchanger between the aerosol-forming substrate and the mouthpiece. The aerosol-cooling element may comprise a plurality of longitudinally extending channels.

The aerosol-cooling element may comprise a gathered sheet of material selected from the group consisting of metallic foil, polymeric material, and substantially non-porous paper or cardboard. In certain embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In certain preferred embodiments, the aerosol-cooling element may comprise a gathered sheet of biodegradable polymeric material, such as polylactic acid (PLA) or a grade of Mater-Bi® (a commercially available family of starch based copolyesters).

Preferably, smoking articles according to the invention comprise an outer wrapper that circumscribes the aerosol-forming substrate and at least a rear portion of the holder. The outer wrapper should grip the holder and the aerosol-forming substrate of the smoking article when the smoking article is assembled.

More preferably, smoking articles according to the invention comprise an outer wrapper that circumscribes the aerosol-forming substrate, at least a rear portion of the holder and any other components of the smoking article downstream of the aerosol-forming substrate.

Smoking articles according to the invention may comprise outer wrappers formed from any suitable material or combination of materials. Suitable materials are well known in the art and include, but are not limited to, cigarette paper.

Smoking articles according to the invention may be assembled using known methods and machinery.

For the avoidance of doubt, features described above in relation to one aspect of the invention may also be applicable to other aspects of the invention. In particular, features described above in relation to smoking articles according to the invention may also relate, where appropriate, to one or both of combustible heat source assemblies according to the invention and methods of manufacturing combustible heat source assemblies according to the invention, and vice versa.

All scientific and technical terms used herein have meanings commonly used in the art unless otherwise specified. The definitions provided herein are to facilitate understanding of certain terms used frequently herein.

The terms 'preferred' and 'preferably' refer to embodiments of the invention that may afford certain benefits, under certain circumstances. Particularly preferred are smoking articles, combustible heat source assemblies and methods of manufacturing combustible heat source assemblies according to the invention comprising combinations of preferred features. However, it will be appreciated that other embodiments may also be preferred, under the same or other circumstances. Furthermore, the recitation of one or more preferred embodiments does not imply that other embodiments are not useful, and is not intended to exclude other embodiments from the scope of the claims.

The smoking article 2 according to the first embodiment of the invention shown in FIG. 1 comprises a blind combustible heat source 4, an aerosol-forming substrate 6 and a non-combustible holder 8 for the combustible heat source 4.

The combustible heat source 4 is a blind cylindrical combustible carbonaceous heat source of substantially circular cross-section having a front end face and an opposed rear end face and is located at the distal end of the smoking article 2.

Figure 2:
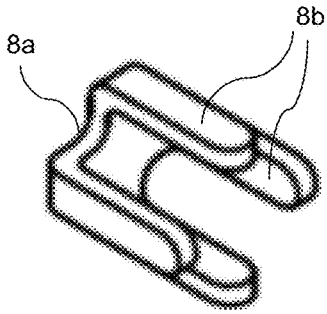
FIG. 2 shows a perspective view of a holder for use in the smoking article shown in FIG. 1.

As shown in FIG. 2, the holder 8 comprises a barrier 8*a* and four first retention fingers 8*b* connected to the barrier 8*a*. The barrier 8*a* is located between the rear end face of the combustible heat source 4 and the front end face of the aerosol-forming substrate 6. The barrier 8*a* is formed from a disc of aluminium foil that extends across the entire rear end face of the combustible heat source 4. The barrier 8*a* is adhered or otherwise affixed to the rear end face of the combustible heat source 4. The four first retention fingers 8*b* are formed from aluminium foil and are substantially uniformly circumferentially spaced apart about the periphery of the combustible heat source 4. The four first retention fingers extend from the barrier 8*a* along the exterior of the combustible heat source beyond the front end face of the combustible heat source. As shown in FIG. 1, the distal ends of the first retention fingers 8*b* are folded inwardly to engage the front end face of the combustible heat source 4. The first retention fingers 8*b* hold the combustible heat source 4 in place within the holder 8.

The aerosol-forming substrate 6 is located immediately downstream of and abuts the barrier 8*a*. The aerosol-forming substrate 6 comprises a cylindrical plug of homogenised tobacco-based material including an aerosol former such as, for example, glycerine, wrapped in plug wrap.

The smoking article 2 further comprises a heat-conducting element 10 of suitable material such as, for example, aluminium foil, around and in direct contact with a rear portion of the holder 8 and a front portion of the aerosol-forming substrate 6.

For the sake of clarity, components of the smoking article 2 downstream of the aerosol-forming substrate 6 have been omitted from FIG. 1. However, as described above, the smoking article 2 may comprise a mouthpiece located at the proximal end thereof. Alternatively or in addition to a mouthpiece, the smoking article 2 may comprise one or more of a transfer element, an aerosol-cooling element and a spacer element downstream of the aerosol-forming substrate 6.

The combustible heat source 4, the aerosol-forming substrate 6, the holder 8, the heat-conducting element 10 and any other components of the smoking article 2 downstream of the aerosol-forming substrate 6 are preferably circumscribed by a wrapper of heat-insulative material such as, for example, cigarette paper (not shown). The smoking article 2 may further comprise a band of tipping paper (not shown) circumscribing a proximal end portion of the wrapper.

Figure 3A:
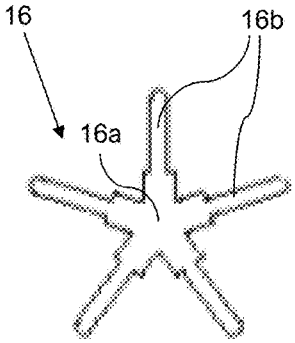
FIGS. 3A, 3B, and 3C show schematic representations of the manufacture of a combustible heat source assembly according to the invention by a method according to an embodiment of the invention.
Figure 3B:
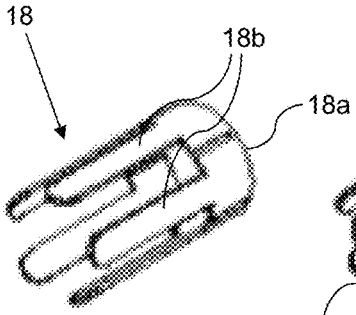
Figure 3C:
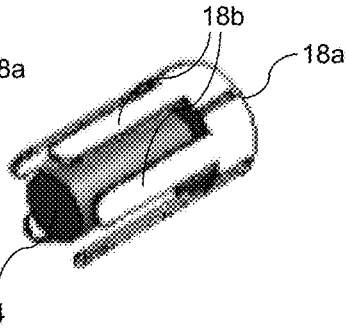

FIGS. 3A, 3B, and 3C show the manufacture of a combustible heat source assembly according to an embodiment of the invention by a method according to an embodiment of the invention.

The combustible heat source assembly is manufactured using a mould defining a cavity having an opening (not shown). A hopper containing a supply of particulate material comprising one or more carbonaceous particulate components, one or more binders and optionally other additives is provided above the cavity. The hopper is slidably mounted relative to the mould, such that it can reciprocate along a line perpendicular to the longitudinal axis of the cavity, and is configured to deposit particulate material into the cavity via an outlet. A punch is provided vertically above the cavity and is arranged such that the longitudinal axis of the punch and the longitudinal axis of the cavity are aligned. The punch is moveable relative to the cavity in a direction parallel to the longitudinal axes thereof.

The method comprises punching a one-piece blank 16 from a sheet of aluminium foil having a thickness of 300 microns. As shown in FIG. 3A, the one piece blank 16 comprises a central portion 16*a* and five fingers 16*b* extending radially outwards from the central portion 16*a*.

To form the non-combustible holder of the combustible heat source assembly, the one piece blank 16 is positioned over the opening of the cavity and the punch advanced downwardly towards the opening of the cavity. As the punch advances downwardly relative to the cavity it engages the blank 16. As the punch enters the cavity through the opening it shapes the blank 16 to form the holder 18. The central portion 16*a* of the blank 16 forms a barrier 18*a* of the holder 18 at the base of the cavity and the five fingers 16*b* of the blank 16 form first retention fingers 18*b* of the holder 18 extending upwardly from the barrier 18*a* along the periphery of the cavity. The shape of the formed holder 18 is shown in FIG. 3B.

Once formation of the holder is complete, the punch retreats upwardly. To form the combustible heat source 4 of the combustible heat source assembly, the hopper is then positioned such that the outlet is located over the opening of the cavity. In this position, the hopper dispenses a supply of the particulate material contained therein into the holder within the cavity through the opening. Once the hopper has dispensed a sufficient quantity of the particulate material into the cavity it retreats moves away from the opening of the cavity. As the hopper moves away from the opening of the cavity, the punch advances downwardly towards the opening of the cavity. As the punch enters the cavity through the opening it compresses the particulate material within the holder 18 in the cavity to form the combustible heat source 4 with the barrier 18*a* of the holder affixed to the rear end face of the combustible heat source 4. As shown in FIG. 3C, the first retention fingers 18*b* extend from the barrier 18*a* along the exterior of the combustible heat source 4 to the front end face thereof.

Once the compressing step is complete, the punch retreats upwardly. As the punch retreats a portion of the mould defining the walls of the cavity is lowered relative to a portion of the mould defining the base of the cavity. In this way, the holder with the combustible heat source therein is ejected from the cavity.

The dimensions of the blank and the amount of particulate material dispensed into the cavity of the mould may be selected such that the length of the first retention fingers 18*b* of the holder 18 is greater than the length of the combustible heat source 4. In such embodiments, the first retention fingers 18*b* extend beyond the front face of the combustible heat source 4 and may be folded inwardly to engage the front face of the combustible heat source.

Figure 4:
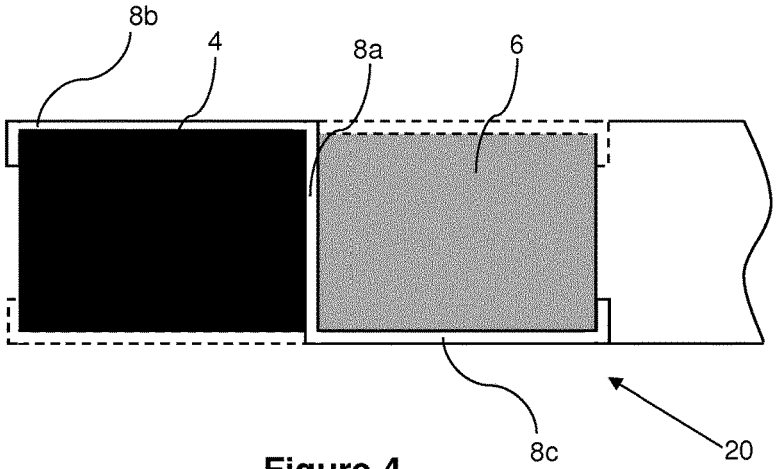
FIG. 4 shows a schematic longitudinal cross-section of a distal portion of a smoking article according to a second embodiment of the invention.

The smoking article 20 according to the second embodiment of the invention shown in FIG. 4 is of similar construction to the smoking article 2 according to the first embodiment of the invention shown in FIG. 1. However in addition to a barrier 8*a* and a plurality of first retention fingers 8*a*, the holder 8 of the smoking article 20 according to the second embodiment of the invention further comprises a plurality of second retention fingers 8*c* connected to the barrier 8*a*. As shown in FIG. 4, the second retention fingers 8*c* are substantially uniformly circumferentially spaced apart about the periphery of the aerosol-forming substrate 6 and extend from the barrier 8*a* along the exterior of the aerosol-forming substrate 6 beyond the rear end face of the aerosol-forming substrate 6. The proximal ends of the second retention fingers 8*c* are folded inwardly to engage the rear end face of the aerosol-forming substrate 6. The second retention fingers 8*c* hold the aerosol-forming substrate 6 in place within the holder 8.

The second retention fingers 8*c* are formed from aluminium foil and provide a thermal link between the combustible heat source 4 and the aerosol-forming substrate 6, which facilitates heat transfer from the combustible heat source 4 to the aerosol-forming substrate 6.

The holder 8 and combustible heat source 4 of the smoking article 20 according to the second embodiment of the invention may be formed by a method similar to that shown in FIGS. 3A, 3B, and 3C, and described above. However, in addition to a central portion 16*a* and a plurality of first fingers 16*b* extending radially outwards from the central portion 16*a*, the one piece blank 16 used to form the holder 8 of the smoking article 20 according to the second embodiment of the invention further comprises a plurality of second fingers extending radially outwards from the central portion 16*a*, which are disposed between the first fingers 16*a* in an alternating arrangement. During formation of the holder 8, the first fingers 16*a* and the second fingers of the blank 16 are folded or bent in opposite directions to form the first retention fingers 8*b* and the second retention fingers 8*c*, respectively, of the holder 8.

Once the holder 8 with the combustible heat source 4 therein is ejected from the cavity, the aerosol-forming substrate 6 is inserted into the holder such that front face of the aerosol-forming substrate 6 abuts the barrier 8*a* and the second retention fingers 8*b* extend from the barrier 8*a* along the exterior of the aerosol-forming substrate 6 beyond the rear end face of the aerosol-forming substrate 6. The proximal ends of the second retention fingers 8*b* are then folded inwardly to engage the rear face of the second retention fingers 8*b*.

The specific embodiments and examples described above illustrate but do not limit the invention. It is to be understood that other embodiments of the invention may be made and the specific embodiments and examples described herein are not exhaustive.

The invention claimed is:

1. A smoking article, comprising:

a combustible heat source having opposed front and rear end faces;

an aerosol-forming substrate having opposed front and rear end faces, wherein the front end face of the aerosol-forming substrate is downstream of the rear end face of the combustible heat source; and a non-combustible holder configured to hold the combustible heat source and comprising a barrier between the rear end face of the combustible heat source and the front end face of the aerosol-forming substrate, and a plurality of first retention fingers connected to the barrier, wherein the first retention fingers extend from the barrier along the exterior of the combustible heat source.

2. The smoking article according to claim 1, wherein the non-combustible holder further comprises a plurality of second retention fingers connected to the barrier, and wherein the second retention fingers extend from the barrier along an exterior of the aerosol-forming substrate.

3. The smoking article according to claim 2 wherein the second retention fingers extend from the barrier along the exterior of the aerosol-forming substrate to the rear end face of the aerosol-forming substrate.

4. The smoking article according to claim 3, wherein proximal ends of the second retention fingers are configured to retain the aerosol-forming substrate within the holder.

5. The smoking article according to claim 2, wherein the second retention fingers are formed integrally with the barrier.

6. The smoking article according to claim 1, further comprising:

a heat-conducting element disposed around and in direct contact with a rear portion of the holder and an adjacent front portion of the aerosol-forming substrate.

7. A combustible heat source assembly for a smoking article, comprising:

a non-combustible holder comprising a barrier and a plurality of retention fingers connected to the barrier; and a combustible heat source having opposed front and rear end faces within the holder, wherein the barrier is adjacent the rear end face of the combustible heat source and the retention fingers extend from the barrier along an exterior of the combustible heat source.

8. The smoking article according to claim 1, wherein the first retention fingers extend from the barrier along an exterior of the combustible heat source to the front end face of the combustible heat source.

9. The smoking article according to claim 8, wherein distal ends of the first retention fingers are configured to retain the combustible heat source within the holder.

10. The smoking article according to claim 1, wherein the first retention fingers are formed integrally with the barrier.

11. The smoking article according to claim 1, wherein the barrier and the first retention fingers are formed from aluminum or an aluminum-containing alloy.

12. The smoking article according to claim 1, wherein the rear end face of the combustible heat source abuts the barrier.

13. The smoking article according to claim 1, wherein the combustible heat source is a combustible carbonaceous heat source.

14. The smoking article according to claim 1, wherein the combustible heat source is formed by a pressing process.

* * * * *